US008417519B2

(12) United States Patent
Kovesi et al.

(10) Patent No.: US 8,417,519 B2
(45) Date of Patent: Apr. 9, 2013

(54) SYNTHESIS OF LOST BLOCKS OF A DIGITAL AUDIO SIGNAL, WITH PITCH PERIOD CORRECTION

(75) Inventors: Balazs Kovesi, Lannion (FR); Stéphane Ragot, Lannion (FR)

(73) Assignee: France Telecom, Paris (FR)

( * ) Notice: Subject to any disclaimer, the term of this patent is extended or adjusted under 35 U.S.C. 154(b) by 0 days.

(21) Appl. No.: 12/446,264

(22) PCT Filed: Oct. 17, 2007

(86) PCT No.: PCT/FR2007/052189

§ 371 (c)(1),
(2), (4) Date: Jul. 15, 2009

(87) PCT Pub. No.: WO2008/096084

PCT Pub. Date: Aug. 14, 2008

(65) Prior Publication Data

US 2010/0318349 A1 Dec. 16, 2010

(30) Foreign Application Priority Data

Oct. 20, 2006 (FR) ..... 06 09227

(51) Int. Cl.
*G10L 21/02* (2006.01)
*G10L 19/14* (2006.01)

(52) U.S. Cl. ..... 704/228; 704/211; 704/225

(58) Field of Classification Search ..... None
See application file for complete search history.

(56) References Cited

U.S. PATENT DOCUMENTS

| | | | | |
|---|---|---|---|---|
| 3,369,077 | A * | 2/1968 | French et al. | 704/207 |
| 5,678,221 | A * | 10/1997 | Cahill | 455/312 |
| 6,597,961 | B1 | 7/2003 | Cooke | |
| 7,305,338 | B2 * | 12/2007 | Tashiro et al. | 704/228 |
| 7,411,985 | B2 * | 8/2008 | Lee et al. | 370/352 |
| 7,962,334 | B2 * | 6/2011 | Tashiro | 704/225 |
| 2003/0163304 | A1 * | 8/2003 | Mekuria et al. | 704/207 |
| 2003/0220787 | A1 * | 11/2003 | Svensson et al. | 704/207 |
| 2008/0046236 | A1 * | 2/2008 | Thyssen et al. | 704/228 |
| 2008/0071530 | A1 * | 3/2008 | Ehara | 704/223 |

OTHER PUBLICATIONS

Serizawa et al., "A Packet Loss Concealment Method Using Pitch Waveform Repetition and Internal State Update on the Decoded Speech for the Sub-Band ADPCM Wideband Speech Codec," Speech Coding, 2002, IEEE Workshop Proceedings, Oct. 6-9, 2002 Piscataway, NJ, USA, IEEE, pp. 68-70 (Oct. 6, 2002).

* cited by examiner

*Primary Examiner* — Brian Albertalli
(74) *Attorney, Agent, or Firm* — Drinker Biddle & Reath LLP

(57) ABSTRACT

The present invention relates to signal modification before pitch period repetition for the synthesis of blocks lost on decoding digital audio signals. The effects of repetition of transitories, such as the plosives of a speech signal, are avoided by comparing the samples of a pitch period with those of the previous pitch period. The signal is modified preferentially by taking the minimum between a current sample (e(3)) of the last pitch period ($T_j$) and at least one sample (e(2−$T_0$) of approximately the same position in the previous pitch period ($T_{j-1}$).

13 Claims, 8 Drawing Sheets

SYNTHESIS OF LOST BLOCKS OF A DIGITAL AUDIO SIGNAL, WITH PITCH PERIOD CORRECTION

CROSS-REFERENCE TO RELATED APPLICATIONS

This application is the U.S. national phase of the International Patent Application No. PCT/FR2007/052189 filed Oct. 17, 2007, which claims the benefit of French Application No. 06 09227 filed Oct. 20, 2006, the entire content of which is incorporated herein by reference.

BACKGROUND OF THE INVENTION

The present invention relates to the processing of digital audio signals (particularly speech signals).

It relates to a coding/decoding system suitable for the transmission/reception of such signals. More particularly, the present invention relates to a processing on reception which makes it possible to improve the quality of the decoded signals when data blocks are lost.

Different techniques exist for digitally converting and compressing a digital audio signal. The most common techniques are:

- waveform encoding methods such as pulse code modulation (PCM) and adaptive differential pulse code modulation (ADPCM).
- analysis-by-synthesis coding methods such as code excited linear prediction (CELP) coding and
- sub-band perceptual coding methods or transform coding.

These techniques process the input signal sequentially, sample by sample (PCM or ADPCM) or by blocks of samples called "frames" (CELP and transform coding). Briefly, it will be recalled that a speech signal can be predicted from its recent past (for example from 8 to 12 samples at 8 kHz) using parameters assessed over short windows (10 to 20 ms in this example). These short-term predictive parameters representing the vocal tract transfer function (for example for pronouncing consonants), are obtained by linear prediction coding (LPC) methods. There is also a longer-term correlation associated with the quasi-periodicities of speech (for example voiced sounds such as the vowels) which are due to the vibration of the vocal cords. This involves determining at least the fundamental frequency of the voice signal, which typically varies from 60 Hz (low voice) to 600 Hz (high voice) according to the speaker. Then a long term prediction (LTP) analysis is used to determine the LTP parameters of a long-term predictor, in particular the inverse of the fundamental frequency, often called "pitch period". The number of samples in a pitch period is then defined by the relationship $F_e/F_0$ (or its integer part), where:

$F_e$ is the sampling rate, and $F_0$ is the fundamental frequency.

It will be recalled therefore that the long-term prediction LTP parameters, including the pitch period, represent the fundamental vibration of the speech signal (when voiced), while the short-term prediction LPC parameters represent the spectral envelope of this signal.

In certain coders, the set of these LPC and LTP parameters thus resulting from a speech coding can be transmitted by blocks to a homologous decoder via one or more telecommunications networks so that the original speech can then be reconstructed.

However, reference will then be made (by way of example) to the G.722 coding system at 48, 56 and 64 kbit/s standardized by ITU-T for the wideband transmission of speech signals (which are sampled at 16 kHz). The G.722 coder has an ADPCM coding scheme in two sub-bands obtained by a quadrature mirror filter bank (QMF). For further details, reference can usefully be made to the text of the G.722 recommendation.

FIG. 1 of the state of the art shows the coding and decoding structure according to the G.722 recommendation. Blocks 101 to 103 represent the transmission QMF filter bank (spectral separation into high 102 and low 100 frequencies and sub-sampling 101 and 103), applied to the input signal Si. The next blocks 104 and 105 correspond respectively to the low-band and high-band ADPCM coders. The low-band output of the ADPCM coder is specified by a mode value of 0, 1, or 2, indicating respectively a 6, 5 or 4-bit output per sample, while the high-band output of the ADPCM coder is fixed (two bits per sample). Within the decoder are the equivalent ADPCM decoding blocks (blocks 106 and 107) the outputs of which are combined in the QMF reception filter bank (over-sampling 108 and 110, inverse filters 109, 111 and merging of the high and low frequency bands 112) in order to generate the synthesis signal So.

A general problem examined here relates to correcting the loss of blocks on decoding.

In fact, the bitstream output from the coding is generally formatted in binary blocks for transmission over many network types. These are called for example "internet protocol (IP) packets" for blocks transmitted via the Internet network, "frames" for blocks transmitted over asynchronous transfer mode (ATM) networks, or others. The blocks transmitted after coding can be lost for various reasons:

- if a network router is overloaded and dumps its queue,
- if the block is received with a delay (therefore not taken into account) during a continuous-flow decoding in real time,
- if a received block is corrupted (for example if its CRC parity code is not verified).

When a loss of one or more consecutive blocks occurs, the decoder must reconstruct the signal without information on the lost or erroneous blocks. It relies on the information previously decoded from the valid blocks received. This problem, called "correction of lost blocks" (or also, hereafter, "correction of erased frames") is in fact more general than simply extrapolating missing information, as the loss of frames often causes a loss of synchronization between coder and decoder, in particular when the latter are predictive, as well as problems of continuity between the extrapolated information and the decoded information after a loss. The correction of erased frames therefore also encompasses status information restoration and re-convergence techniques and others.

Annex I of the ITU-T G.711 recommendation describes a correction of erased frames suitable for PCM coding. As PCM coding is not predictive, the correction of frame losses therefore simply amounts to extrapolating the missing information and ensuring the continuity between a reconstructed frame and the correctly received frames, following a loss. The extrapolation is implemented by repetition of the past signal in a manner synchronous with the fundamental frequency (or inversely, "pitch period"), i.e. simply by repeating the pitch periods. The continuity is ensured by a smoothing or cross-fading between received samples and extrapolated samples.

In the document:

"*A packet loss concealment method using pitch waveform repetition and internal state update on the decoded speech for the sub-band ADPCM wideband speech codec*", M. Serizawa and Y. Nozawa, IEEE Speech Coding Workshop, pages 68-70 (2002), a correction of erased frames was proposed for the G.722 standardized coder/decoder by extrapolating a lost frame using a pitch-period repetition algorithm (repetition which can be similar to that described in Annex I of the G.711 recommendation). In order to update G.722 coder states (filter memory and pitch adaptation memory), the frame thus extrapolated is divided into two sub-bands which are re-encoded by ADPCM coding.

However, such techniques for the correction of frame losses by repetition of pitch periods can only operate correctly if the past signal is stationary or at least cyclostationary. They therefore rely on the implicit hypothesis that the signal associated with the lost frame (that must be extrapolated) is "similar" to the signal decoded up to the frame loss. In the case of the speech signal, this stationarity hypothesis is only strictly valid for sounds such as a portion of vowels to be repeated. For example, a vowel "a" can be repeated several times (which gives "aaaa, etc." without causing hearing discomfort). A speech signal comprises sounds called "transitories" (non-stationary sounds typically including the attacks (beginnings) of vowels and the sounds called "plosives" which correspondent to the short consonants such as "p", "b", "d", "t", "k"). Thus, if for example a frame is lost immediately after the sound "t", a correction of a loss of frames by simple repetition will generate a sequence of a burst of "t"s ("t-t-t-t-t"), which is very unpleasant to the ear, when there is a loss of several successive frames (for example five consecutive losses).

FIGS. 2*a* and 2*b* illustrate this acoustic effect in the case of a wideband signal encoded by a coder according to the G.722 recommendation. More particularly, FIG. 2*a* shows a speech signal decoded on an ideal channel (without frame loss). In the example shown, this signal corresponds to the French word "temps", divided into two French phonemes: /t/ then /an/. The vertical dotted lines show the boundaries between frames. The length of the frames under consideration here is of the order of 10 ms. FIG. 2*b* shows the signal decoded according to a technique similar to that of Serizawa et at cited above, when a loss of frames immediately follows the phoneme /t/. This FIG. 2*b* clearly shows the problem of repetition of the past signal. It is noted that the phoneme /t/ is repeated in the extrapolated frame. It is also present in the next frame (s) as the extrapolation is slightly extended after a loss, in the example shown, in order to carry out a cross-fading with the decoding under normal conditions (i.e. in the presence of useful data in the received signal).

The problem of repetition of plosives has apparently never been mentioned in the known prior art.

SUMMARY OF THE INVENTION

The present invention offers an improvement on the situation.

To this end it proposes a method for synthesizing a digital audio signal represented by consecutive blocks of samples, in which on receiving such a signal, in order to replace at least one invalid block, a replacement block is generated from the samples of at least one valid block.

The method generally comprises the following steps:

a) defining a repetition period of the signal in at least one valid block, and b) copying the samples of the repetition period into at least one replacement block.

In the method within the meaning of the invention:

in step a), a last repetition period is determined in at least one valid block immediately preceding an invalid block, and in step b), the samples of the last repetition period are corrected according to samples from a previous repetition period, in order to limit the amplitude of any transitory signal which could be present in the last repetition period.

The samples thus corrected are then copied into the replacement block.

The method within the meaning of the invention can advantageously be applied to the processing of a speech signal, equally well in the case of a voiced signal as in the case of a non-voiced signal. Thus, if the signal is voiced, the repetition period consists simply of the pitch period and step a) of the method involves in particular determining a pitch period (typically given by the inverse of a fundamental frequency) of a tone of the signal (for example the tone of a voice in a speech signal) in at least one valid block preceding the loss.

If the valid signal received is non-voiced, there is in fact no detectable pitch period. In this case, it can be provided to set an arbitrary given number of samples which will be considered as the length of the pitch period (that can then be referred to generically as the "repetition period") and to implement the method within the meaning of the invention on the basis of this repetition period. For example, a pitch period can be chosen which is as long as possible, typically 20 ms (corresponding at 50 Hz to a very low voice), i.e. 160 samples at 8 kHz sampling frequency. It is also possible to take the value corresponding to the maximum of a correlation function by limiting the search within a value interval (for example between MAX_PITCH/2 and MAX_PITCH, where MAX_PITCH is the maximum value in the pitch period search).

Preferentially, if a plurality of consecutive invalid blocks must be replaced on reception and that these blocks extend over at least one repetition period, the sample correction step b) is applied to all the samples of the last repetition period, taken one by one as the current sample.

Moreover, if these invalid blocks even extend over several repetition periods, the repetition period thus corrected in step b) is copied several times in order to form the replacement blocks.

In a particular embodiment, for the above-mentioned sample correction which is carried out in step b), the following procedure can be adopted. For a current sample from the last repetition period, a comparison is made between:

the amplitude of this current sample, in absolute value, and the amplitude, in absolute value, of at least one sample temporally positioned approximately at a repetition period before the current sample, and the minimum amplitude in absolute value from these two amplitudes is assigned to the current sample, while of course also assigning its original amplitude sign to it.

By the term "positioned approximately" is meant the fact that a neighbourhood is sought in the previous repetition period with which to associate the current sample. Thus, preferentially, for a current sample of the last repetition period:

a set of samples is constituted in a neighbourhood centred around a sample temporally positioned at a repetition period before the current sample, a chosen amplitude is determined from the amplitudes of the samples of said neighbourhood, taken in absolute value, and this chosen amplitude is compared to the amplitude of the current sample, in absolute value, in order to assign to the current sample the minimum amplitude, in absolute value, from the chosen amplitude and the amplitude of the current sample.

This amplitude chosen from the amplitudes of the samples of said neighbourhood is preferentially the maximum amplitude in absolute value.

Moreover, a damping (progressive attenuation) is usually applied to the amplitude of the samples in the replacement blocks. In this case, advantageously, a transitory feature of the signal is detected before the loss of blocks and if appropriate, a damping is applied that is quicker than for a stationary (non transitory) signal.

Additionally or as a variant, it is also possible to carry out an update (zero reset) of the next filter memories during the synthesis processing, specifically adapted to the transitory sounds, in order to avoid experiencing the influence of such transitory sounds in the processing of the next valid blocks.

Preferentially, the detection of a transitory signal preceding the loss of a block is carried out as follows:

- for a plurality of current samples of the last repetition period, a relationship is measured, in absolute value, of the amplitude of a current sample to the above-mentioned chosen amplitude (determined in the neighbourhood as stated above), and
- then counting the number of occurrences, for the current samples, for which the above-mentioned relationship is greater than a first predetermined threshold (a value around 4 for example, as will be seen below), and
- detecting the presence of a transitory signal if the number of occurrences is greater than a second predetermined threshold (for example if there is more than one instance, as will be seen below).

These above-mentioned steps can also be exploited to trigger the correction step b) within the meaning of the invention, in the case of detection of a transitory sound in the repetition period immediately preceding the loss of a block.

However, in order to decide whether or not to apply the correction step b) of the method within the meaning of the invention, the following procedure is preferentially carried out. If the digital audio signal is a speech signal, a degree of voicing in the speech signal is advantageously detected, and the correction in step b) is not implemented if the speech signal is highly voiced (which is shown by a correlation coefficient close to "1" in the search for a pitch period). In other words, this correction is implemented only if the signal is non-voiced or if it is weakly voiced.

Thus applying the correction of step b) and unnecessarily attenuating the signal in the replacement blocks is avoided if the valid signal received is highly voiced (therefore stationary), which corresponds in reality to the pronunciation of a stable vowel (for example "aaaa").

Thus, in brief, the present invention relates to signal modification before repetition of the repetition period (or "pitch" for a voiced speech signal), for the synthesis of blocks lost on decoding digital audio signals. The effects of repetition of transitories are avoided by comparing the samples of a pitch period with those from the previous pitch period. The signal is modified preferentially by taking the minimum between the current sample and at least one sample approximately from the same position of the previous pitch period.

The invention offers several advantages, in particular in the context of decoding in the presence of block losses. It makes it possible in particular to avoid the artefacts arising from the erroneous repetition of transitories (when a simple pitch repetition period is used). Moreover, it carries out a detection of transitories which can be used to adapt the energy control of the extrapolated signal (via a variable attenuation).

BRIEF DESCRIPTION OF THE DRAWINGS

Further advantages and features of the invention will become apparent on inspection of the detailed description given by way of example hereafter, and of the attached drawings in which, in addition to FIGS. 1, 2*a* and 2*b* mentioned above.

DETAILED DESCRIPTION OF THE INVENTION

Figure 1:
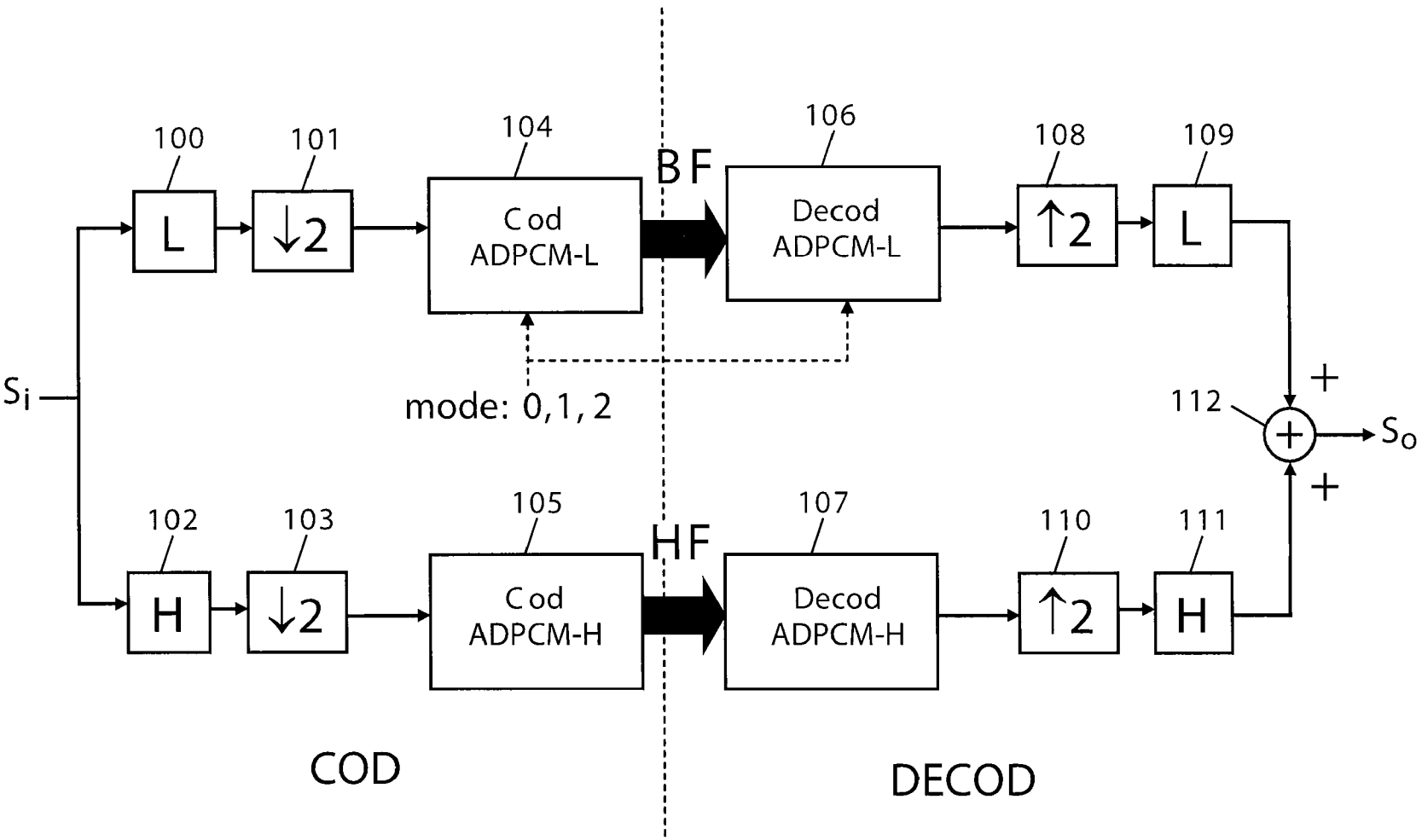

An embodiment of the invention relying by way of example on the coding system according to the G.722 recommendation is described hereafter. The description of the G.722 coder (described above with reference to FIG. 1) will not be repeated here. The description here will be limited to a modified G.722 decoder which integrates a corrector of pitch periods to be reproduced in the case of a loss of frames.

Figure 3:
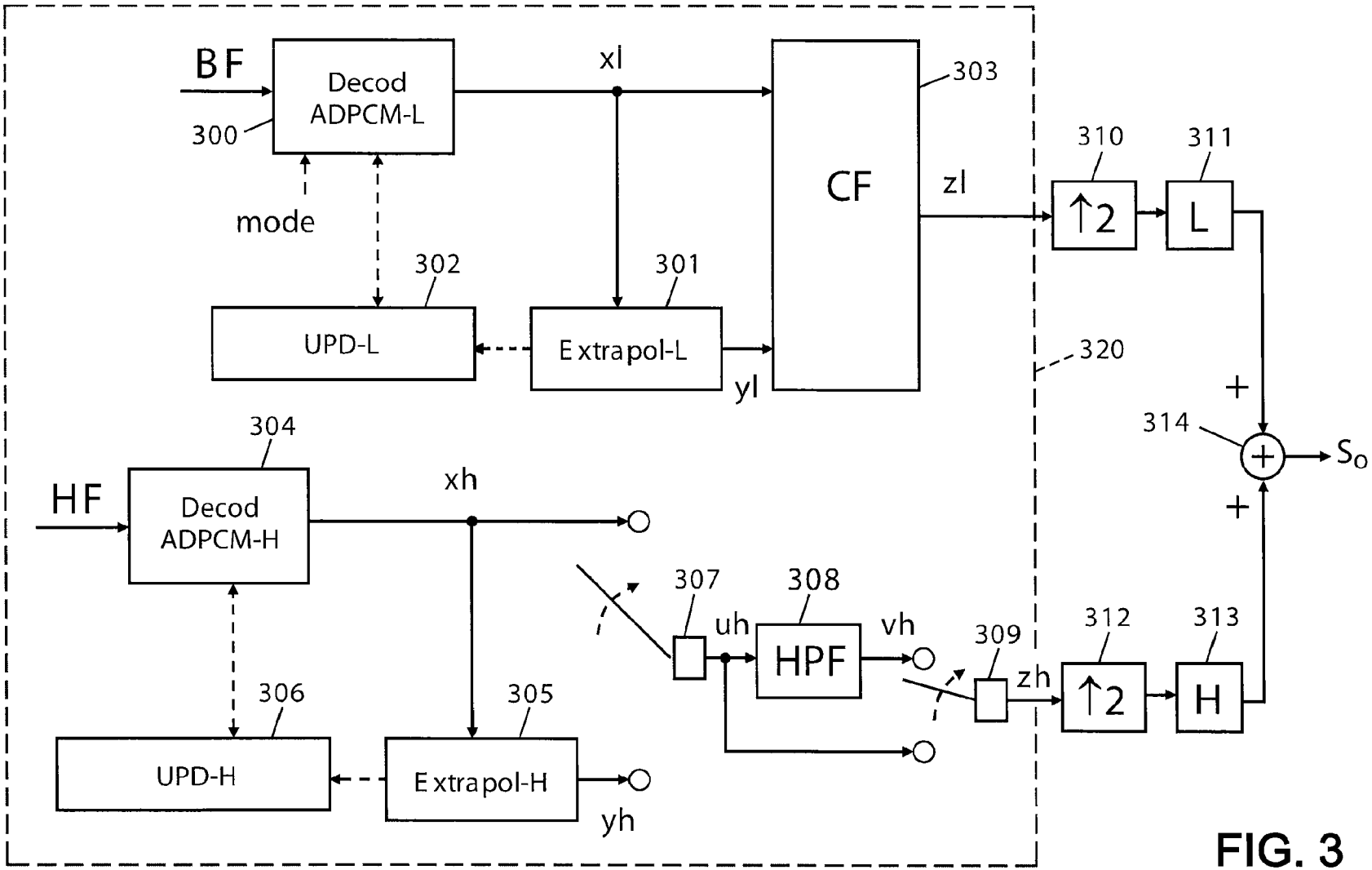
FIG. 3 represents the decoder according to the G.722 recommendation, but modified by integrating a device for correcting erased frames within the meaning of the invention.

With reference to FIG. 3, the decoder within the meaning of the invention (here according to the G.722 recommendation) again shows an architecture in two sub-bands with QMF reception filter banks (blocks 310 to 314). With respect to the decoder of FIG. 1, the decoder of FIG. 3 integrates in addition a device 320 for the correction of erased frames.

The G.722 decoder generates an output signal So sampled at 16 kHz and partitioned into temporal frames (or blocks of samples) of 10, 20 or 40 ms. Its operation differs according to the presence or absence of a loss of frames.

In the total absence of a loss of frames (therefore if all the frames are received and valid, the bitstream of the low-frequency band LF is decoded by the block 300 of the device 320 within the meaning of the invention, no cross-fade (block 303) is carried out, and the reconstructed signal is given simply by zl=xl. Similarly, the bitstream of the band of high frequencies HF is decoded by the block 304. The switch 307 selects the channel uh=xh and the switch 309 selects the channel zh=uh=xh.

Nevertheless, in case of loss of one or more frames, in the low band LF, the erased frame is extrapolated in the block 301 from the past signal xl (copy of the pitch in particular) and the states of the ADPCM decoder are updated in the block 302. The erased frame is reconstructed as zl=yl. This procedure is repeated whenever a loss of frames is detected. It is important to note that the extrapolation block 301 is not restricted only to generating an extrapolated signal on the current (lost) frame: it also generates 10 ms of signal for the next frame in order to carry out a cross-fade in the block 303.

Then, when a valid frame is received, the latter is decoded by the block 300 and a cross-fade 303 is carried out during the first 10 milliseconds between the valid frame xl and the previously extrapolated frame yl.

In the high band HF, the erased frame is extrapolated in the block 305 from the past signal xh and the states of the ADPCM decoder are updated in the block 306. In the preferred embodiment, the extrapolation yh is a simple repetition of the last period of the past signal xh. The switch 307 selects the path uh=yh.

This signal uh is advantageously filtered in order to produce the signal vh. In fact, the G.722 encoding is a backward predictive coding scheme. In each sub-band it uses a prediction operation of the auto-regressive moving average (ARMA) type and a procedure for adaptation of the pitch quantization and adaptation of the ARMA filter, identical at the coder and at the decoder. The prediction and adaptation of the pitch rely on the decoded data (prediction error, reconstructed signal).

The transmission errors, more particularly the losses of frames, result in a desynchronization between the variables of the decoder and the coder. The pitch adaptation and prediction procedures are then erroneous and biased over a significant period of time (up to 300-500 ms). In the high band, this bias can result, among other artefacts, in the appearance of a very weak direct component of amplitude (of the order of +/−10 for a signal with maximum dynamics +/−32767).

However, after passing through the QMF synthesis filter bank, this direct component adopts the form of a sine wave at 8 kHz which is audible and very unpleasant to the ear.

Figure 8:
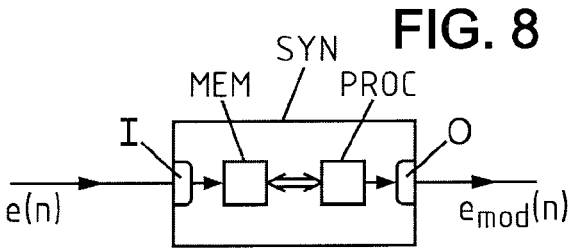
FIG. 8 illustrates diagrammatically a synthesis device for the implementation of the method within the meaning of the invention.
Figure 8A:
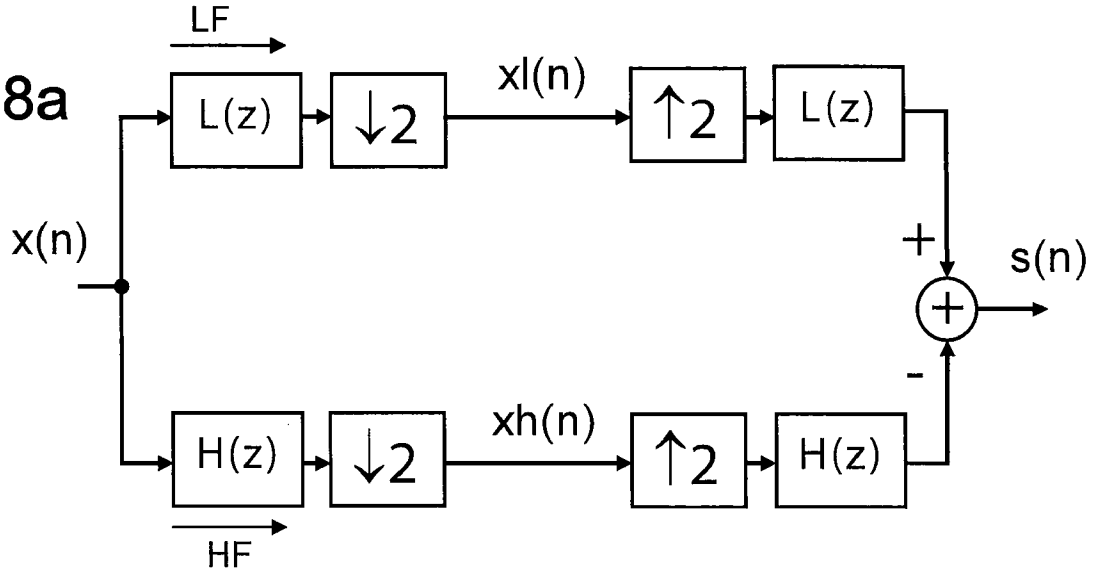
FIG. 8*a* illustrates the general structure of a of two-channel quadrature mirror filter bank (QMF)

The transformation of the direct component (or "DC component") into a sine wave at 8 kHz is explained hereafter. FIG. 8*a* represents a two-channel quadrature filter bank (QMF). The signal x(n) is resolved into two sub-bands by the analysis bank. Thus a low band xl(n) and a high band xh(n) are obtained. These signals are defined by their z transform:

$$XL(z) = \frac{1}{2}\left(X\left(z^{\frac{1}{2}}\right)L\left(z^{\frac{1}{2}}\right) + X\left(-z^{\frac{1}{2}}\right)L\left(-z^{\frac{1}{2}}\right)\right)$$

$$XH(z) = \frac{1}{2}\left(X\left(z^{\frac{1}{2}}\right)H\left(z^{\frac{1}{2}}\right) + X\left(-z^{\frac{1}{2}}\right)H\left(-z^{\frac{1}{2}}\right)\right)$$

As the low-pass L(z) and high-pass H(z) filters are in quadrature, then: H(z)=L(−z).

If L(z) verifies the constraints of perfect reconstruction, the signal obtained after the synthesis filter bank is identical to the signal x(n), to the nearest time delay.

Thus, if the sampling frequency of the signal x(n) is $f_e$, the signals xl(n) and xh(n) are sampled at the frequency $f_e=f'_e/2$. Typically, one often has $f_e'$=16 kHz, i.e. $f_e$=8 kHz. It is indicated moreover that the filters L(z) and H(z) can be for example the 24-coefficient QMF filters specified in ITU-T recommendation G.722.

Figure 8B:
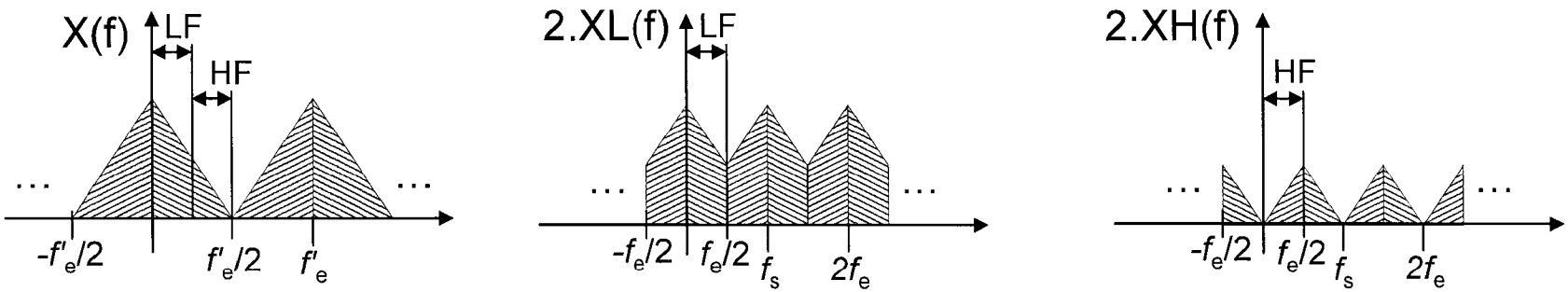
FIG. 8*b* represents the signal spectra x(n), xl(n), xh(n) of FIG. 8*a* when the L(z) and H(z) filters are ideal (i.e. $f'_e=2f_e$).

FIG. 8*b* shows the spectrum of the signals x(n), xl(n) and xh(n) in the case where the filters L(z) and H(z) are ideal mid-band filters. The L(z) frequency response over the interval [−f'e/2, +fe'/2] is then given, in the ideal case, by:

$$|L(f)| = \begin{cases} 1 & \text{if } |f| \le f'_e/4 \\ 0 & \text{otherwise} \end{cases}$$

It is noted that the xh(n) spectrum corresponds to the folded high band. This "folding" property, well known in the state of the art, can be explained visually, as well as by means of the above equation defining XH(z). The folding of the high band is "inverted" by the synthesis filter bank which restores the high band spectrum in the natural order of frequencies.

However, in practice, the L(z) and H(z) filters are not ideal. Their non-ideal character results in the appearance of a spectral folding component which is cancelled by the synthesis filter bank. The high band nevertheless remains inverted.

Block 308 then carries out a high-pass filtering (HPF) which removes the direct component ("DC remove"). The use of such a filter is particularly advantageous, including outside the scope of the low-band pitch period correction within the meaning of the invention.

Moreover, the use of such a HPF filter (block 308) removing the direct component in the high band could be the subject of a separate protection, in a general context of a loss of frames on decoding. In generic terms, it will be understood therefore that in the context of decoding of a received signal with separation of this signal into a band of high frequencies and a band of low frequencies, thus into at least two channels as in decoding according to the G.722 standard, when a signal loss occurs followed by a synthesis of a replacement signal, generally, on the high-frequency path of the decoder, this can result in the presence of a direct component in the replacement signal. The effect of this direct component can also extend into the decoded signal, during a certain time, despite the received coded signal being valid once again, due to the desynchronization between the coder and the decoder and the memory size of the filters.

Advantageously, a high-pass filter 308 is provided on the high-frequency path. This high-pass filter 308 is advantageously provided upstream for example of the QMF filter bank of this high-frequency path of the G.722 decoder. This arrangement makes it possible to avoid the folding of the direct component at 8 kHz (value taken from the sampling rate $f'_e$) when it is applied to the QMF filter bank. More generally, when the decoder involves a filter bank at the end of processing on the high-frequency path, preferentially the high-pass filter (308) is provided upstream of this filter bank.

Thus, referring again to FIG. 3, the switch 309 selects the path zh=vh, as long as there is a loss of frames.

Then, as soon as a valid frame is received, the latter is decoded by the block 304 and the switch 307 selects the path uh=xh. For the next few moments (for example after four seconds), the switch 309 again selects the path zh=vh, but after these few seconds have passed, there is a return to the "normal" operation where the switch 309 again selects the path zh=uh, bypassing the block 308 and therefore without applying the high-pass filter 308.

In generic terms, it will therefore be understood that, preferentially, this high-pass filter 308 is applied temporarily (for a few seconds for example) during and after a loss of blocks, even if valid blocks are again received. The filter 308 could be used permanently. However, it is only activated in the case of frame losses, as the disturbance due to the direct component is only generated in this case, such that the output of the modified G.722 decoder (integrating the loss correction mechanism) is identical to that of the ITU-T G.722 decoder in the absence of the loss of frames. This filter 308 is applied only during the correction for the loss of frames and for a few consecutive seconds when a loss occurs. In fact, in the case of loss, the G.722 decoder is desynchronized from the coder for a period of 100 to 500 ms following a loss and the direct component in the high band is typically present only for a duration of 1 to 2 seconds. The filter 308 is kept on a little longer in order to have a safety margin (for example four seconds).

The decoder which is the subject of FIG. 3 will not be described in further detail, as it is understood that the invention is particularly implemented in the low-band extrapolation block 301. This block 301 is detailed in FIG. 4.

Figure 4:
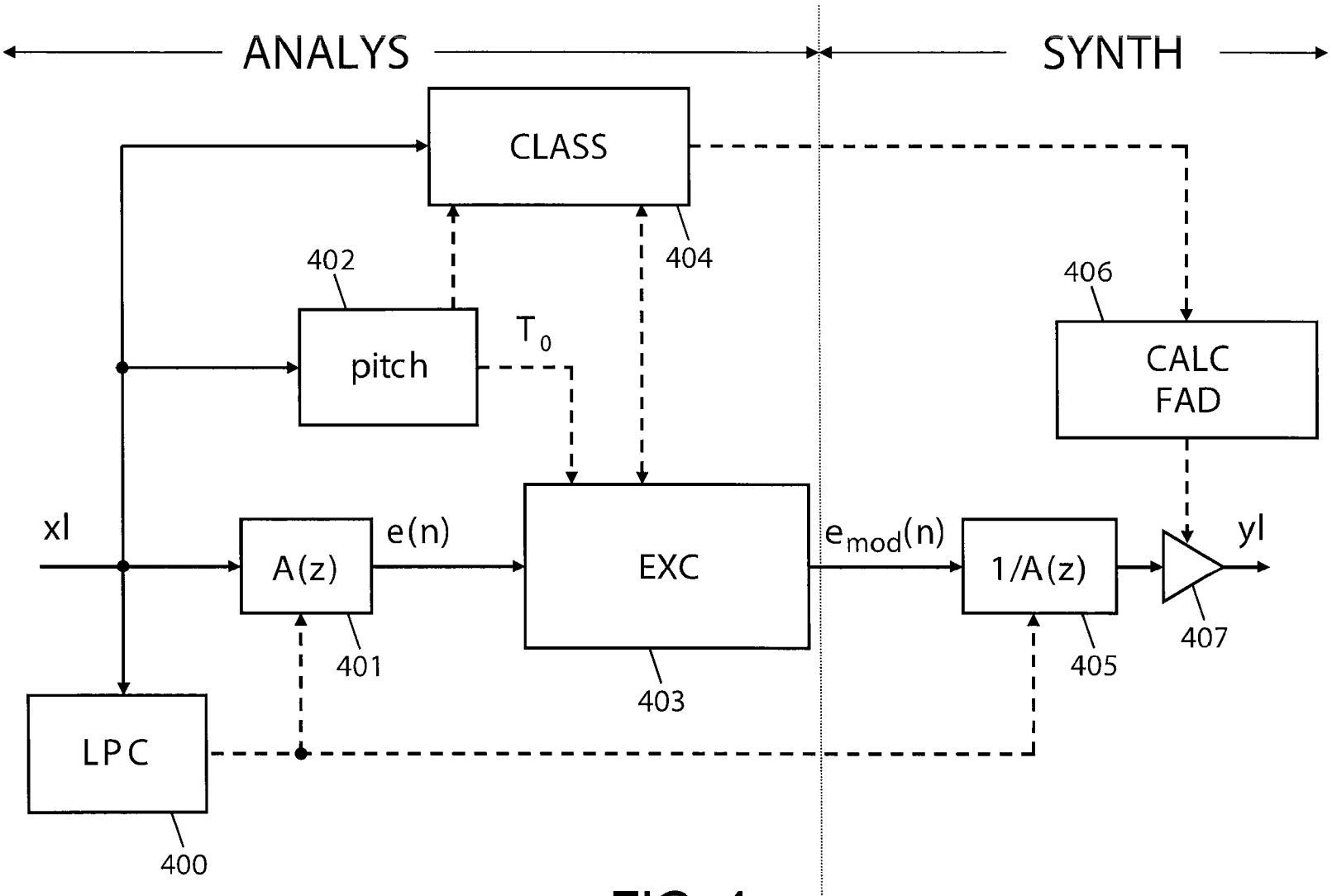
FIG. 4 illustrates the principle of extrapolation of the low band.

With reference to FIG. 4, the extrapolation of the low band relies on an analysis of the past signal xl (part of FIG. 4 denoted ANALYS) followed by a synthesis of the signal yl to be delivered (part of FIG. 4 denoted SYNTH). The block 400 carries out a linear prediction analysis (LPC) on the past signal xl. This analysis is similar to that carried out in particular in the standardized G.729 coder. It can consist of windowing the signal, calculating the autocorrelation and using the Levinson-Durbin algorithm to find the linear prediction coefficients. Preferentially, only the last 10 seconds of the signal are used and the LPC order is set at 8. Thus nine LPC coefficients are obtained (hereafter called $a_0, a_1 \ldots, a_p$) in the form:

$$A(z)=a_0+a_1z^{-1}+\ldots+a_pz^{-p} \text{ with } p=8 \text{ and } a_0=1.$$

After LPC analysis, the past excitation signal is calculated by the block 401. The past excitation signal is called e(n) with n=−M, . . . , −1, where M corresponds to the number of past samples stored.

The block 402 carries out an estimation of the fundamental frequency or its inverse: the pitch period $T_0$. This estimation is carried out for example in a similar way to the pitch analysis (called "open loop" in particular as in the standardized G.729 coder).

The pitch $T_0$ thus estimated is used by the block 403 to extrapolate the excitation of the current frame.

Moreover, the past signal xl is classified in the block 404. It is possible here to seek to detect the presence of transitories, for example the presence of a plosive, in order to apply the pitch period correction within the meaning of the invention, but, in a preferential variant, it is sought instead to detect if the signal Si is highly voiced (for example when the correlation with respect to the pitch period is very close to 1). If the signal is highly voiced (which corresponds to the pronunciation of a stable vowel, for example "aaaa . . . "), then the signal Si is free of transitories and it is possible not to implement the pitch period correction within the meaning of the invention. Otherwise, preferentially, the pitch period correction within the meaning of the invention will be applied in all other cases.

The details of the detection of a degree of voicing are not given here as they are known per se and are outside the scope of the invention.

Referring again to FIG. 4, the synthesis SYNTH follows the model well known in the state of the art and called "source-filter". It consists of filtering the extrapolated excitation by an LPC filter. Here, the extrapolated excitation e(n) (where now n=0, . . . , L−1, L being the length of the frame to be extrapolated) is filtered by the inverse filter 1/A(z) (block 405). Then, the signal obtained is attenuated by the block 407 according to an attenuation calculated in the block 406, to be finally delivered at yl.

The invention as such is implemented by the block 403 of FIG. 4, the functions of which are described in detail hereafter.

Figure 5:
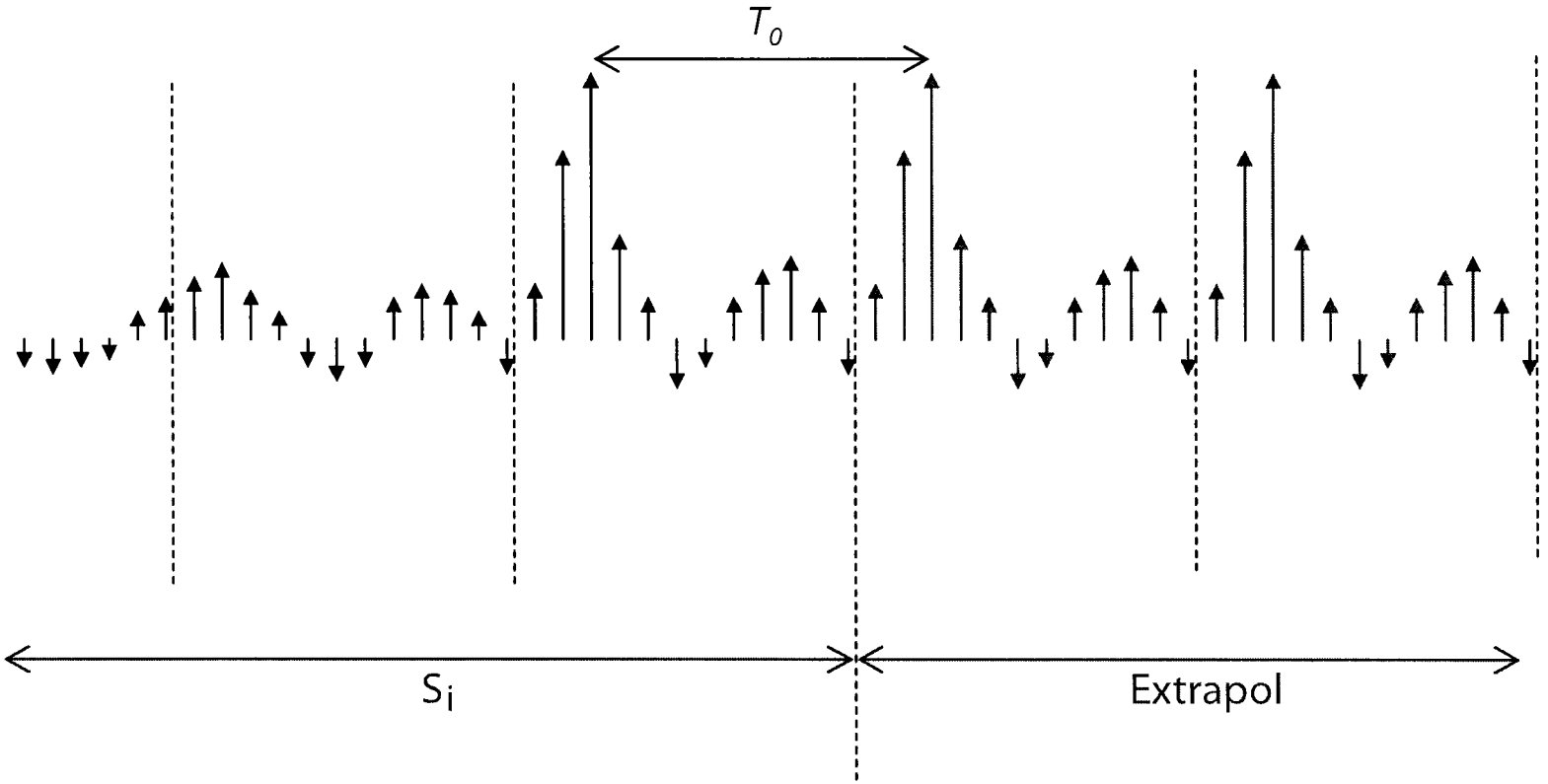
FIG. 5 illustrates the principle of pitch repetition (in the excitation domain)

FIG. 5 shows, for the purposes of illustration, the principle of the simple excitation repetition as implemented in the state of the art. The excitation can be extrapolated simply by repeating the last pitch period $T_0$, i.e. by copying the succession of the last samples of the past excitation, the number of samples in this succession corresponding to the number of samples comprised by the pitch period $T_0$.

Figure 6:
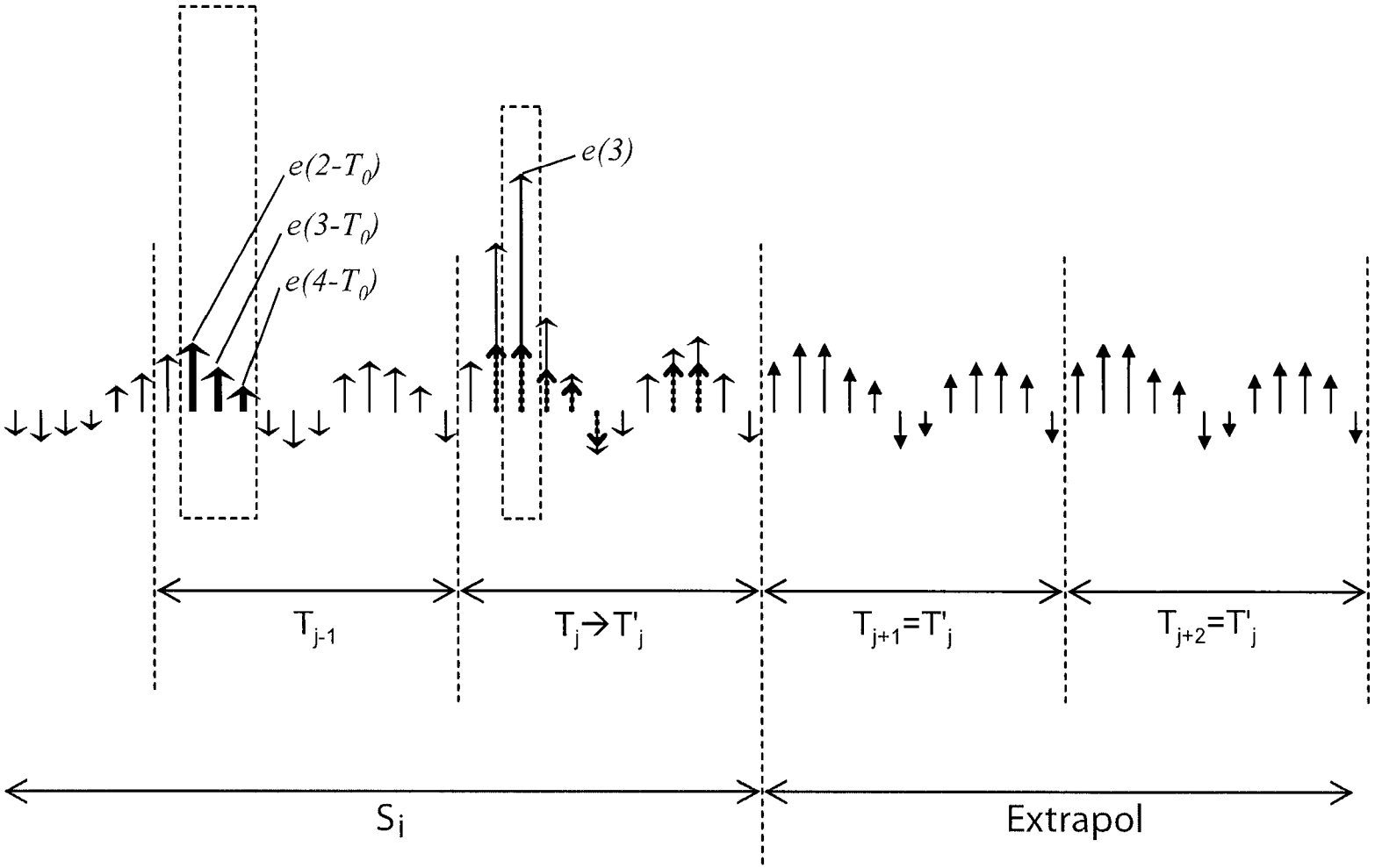
FIG. 6 illustrates the modification of the excitation signal within the meaning of the invention, followed by the pitch repetition.

Referring now to FIG. 6, before repeating the last pitch period $T_0$, the latter is modified, within the meaning of the invention, as follows.

For each sample n=−$T_0$, . . . , −1, the sample e(n) is modified to $e_{mod}(n)$ according to a formula of the type:

$$e_{mod}(n) = \min\left(\max_{i=-k,etc.,0,etc.,+k}(|e(n-T_0+i)|), |e(n)|\right)\times \text{sign}\,(e(n))$$

As stated above, preferentially, this signal modification is not applied if the signal xl (and therefore the input signal Si) is highly voiced. In fact, in the case of a highly voiced signal, the simple repetition of the last pitch period, without modification, can produce a better result, while a modification of the last pitch period and its repetition could cause a slight deterioration of quality.

Figure 7:
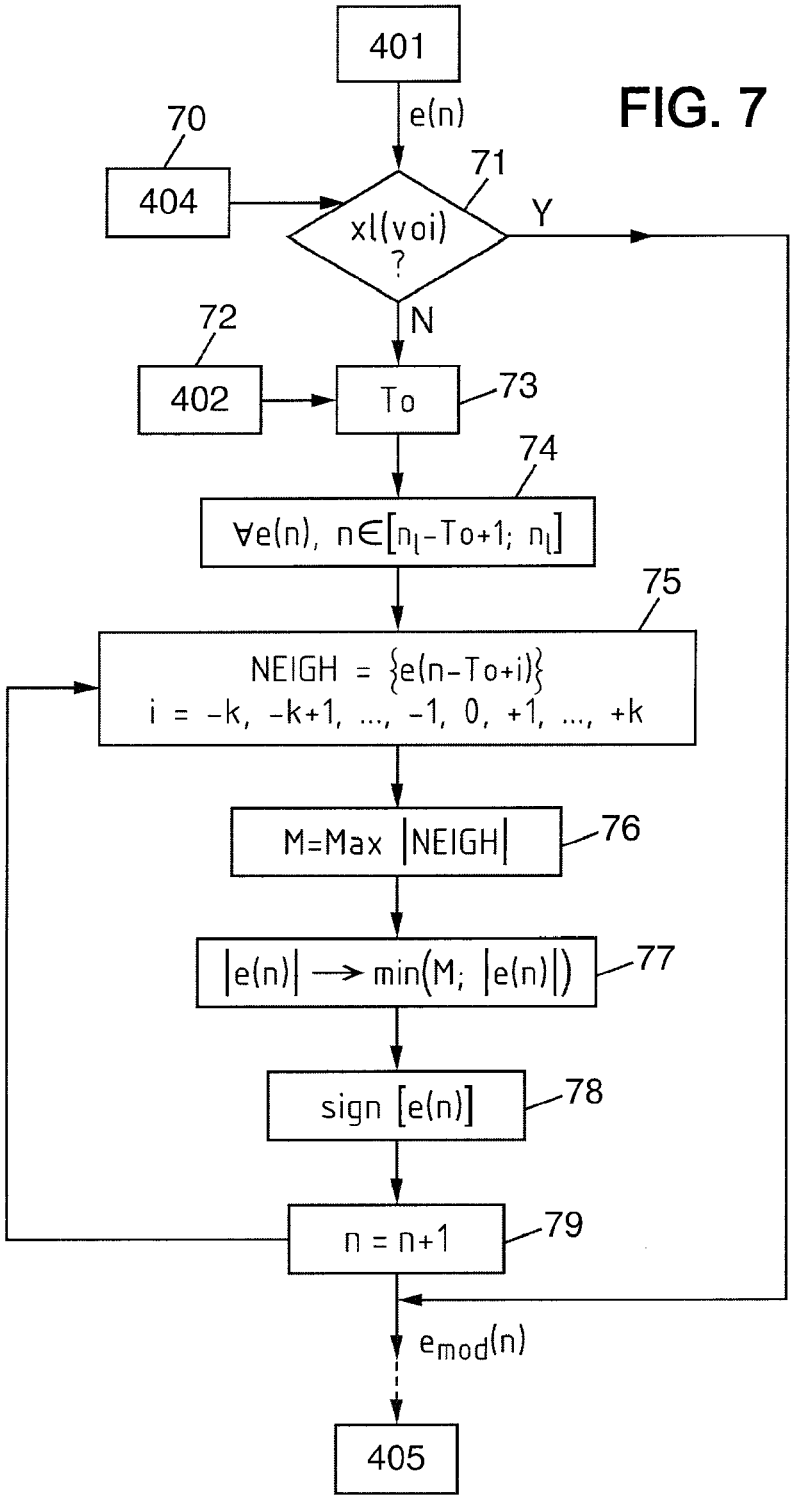
FIG. 7 illustrates the steps of the method of the invention, according to a particular embodiment.

FIG. 7 shows the processing corresponding to the application of this formula, in the form of a flow chart, in order to illustrate the steps of the method according to an embodiment of the invention. Here the starting point is the past signal e(n) delivered by the block 401. In step 70, the information is obtained according to which the signal xl is highly voiced or not, from the module 404 which determined the degree of voicing. If the signal is highly voiced (arrow O at the output of test 71), the last pitch period of the valid blocks is copied just as it is in the block 403 of FIG. 4 and the processing then continues directly by application of the inverse filtering 1/A (z) by the module 405.

On the other hand, if the signal xl is not highly voiced (arrow N at the output of the test 71), it will be sought to modify the last samples of the excitation signal e(n) corresponding to the last valid blocks received, these samples extending over the whole of a pitch period $T_0$ (step 73), given by the module 402 of FIG. 4 (in step 72).

In the embodiment illustrated in FIG. 7, it is sought to modifier all the samples e(n) over the whole of a pitch period $T_0$, with n comprised between $n_1-T_0+1$ and $n_1$, $e(n_1)$ thus corresponding to the last valid sample received (step 74). It will thus be understood, with these notations, that a sample e(n) with n comprised between $n_1-T_0+1$ and $n_1$ belongs simply to the last validly received pitch period.

In step 75, a neighbourhood NEIGH of the previous pitch period is made to correspond to each sample e(n) of the last pitch period, thus in the penultimate pitch period. This measure is advantageous but in no way necessary. The advantage that it provides will be described below. It will simply be stated here that this neighbourhood comprises a odd number of samples 2k+1, in the example described. Of course, in a variant, this number can be even. Moreover, in the example in FIG. 6, we have k=1. In fact, referring again to FIG. 6, it will be noted that the third sample of the last pitch period called e(3) is selected (step 74) and the samples of the neighbourhood NEIGH which are associated with it in the penultimate pitch period (step 75) are represented in bold and are e(2−$T_0$), e(3−$T_0$) and e(4−$T_0$). They are therefore distributed around e(3−$T_0$).

In step 76, the maximum is determined in absolute value from the samples of the neighbourhood NEIGH (i.e. the sample e(2−$T_0$) in the example of FIG. 6). This feature is advantageous but in no way necessary. The advantage that it provides is described below. Typically, in a variant, it is possible to choose to determine the average over the neighbourhood NEIGH, for example.

In step 77, the minimum is determined in absolute value between the value of the current sample e(n) and the value of the maximum M found over the neighbourhood NEIGH in step 76. In the example illustrated in FIG. 6, this minimum between e(3) and e(2−$T_0$) is actually the sample of the penultimate pitch period e(2−$T_0$). Still in this step 77, the amplitude of the current sample e(n) is then replaced by this minimum. In FIG. 6, the amplitude of sample e(3) becomes equal to that of sample e(2−$T_0$). The same method is applied to all the samples of the last period, from e(1) to e(12). In FIG. 6, the corrected samples have been replaced by dotted lines. The samples of the extrapolated pitch periods $T_{j+1}$, $T_{j+2}$, corrected according to the invention, are represented by closed arrows.

It will thus be understood that, by the advantageous implementation of this step 77, if a plosive is actually present over the last pitch period $T_j$ (high signal intensity in absolute value, as shown in FIG. 6), the minimum will be determined between this intensity of the plosive and that of the samples approximately at the same temporal position in the previous pitch period (the term "approximately" here meaning "to the nearest neighbourhood±k", producing the advantage of the embodiment in step 75), and if appropriate replacing the intensity of the plosive by a lower intensity belonging to the penultimate pitch period $T_{j-1}$. On the other hand, if the intensity of the samples of the last pitch period $T_j$ is less than that of the penultimate period $T_{j-1}$, by selecting the minimum between the current sample e(3) and the intensity value e(2−$T_0$) in the penultimate period $T_{j-1}$, the last period is not modified, thus avoiding the risk of a plosive (having a high intensity) being copied from the penultimate pitch period $T_{j-1}$.

Thus, in step 76, it is possible to determine the maximum M in absolute value of the samples of the neighbourhood (and not another parameter such as the average over this neighbourhood, for example) in order to compensate for the effect of choosing the minimum in step 77 for carrying out the replacement of the value e(n). This measure thus makes it possible to avoid limiting the amplitude of the replacement pitch periods $T_{j+1}$, $T_{j+2}$ (FIG. 6).

Moreover, the step 75 of neighbourhood determination is advantageously implemented, as a pitch period is not always regular and if a sample e(n) has a maximum intensity in a pitch period $T_0$, this is not always the case for a sample e(n+$T_0$) in a next pitch period. Moreover, a pitch period can extend up to a temporal position falling between two samples (at a given sampling frequency). This is called "fractional pitch". It is thus always preferable to take a neighbourhood centred around a sample e(n−$T_0$), if it is necessary to associate this sample e(n−$T_0$) with a sample e(n) positioned at a next pitch period.

Finally, since the processing of the steps 75 to 77 relates essentially to the absolute values of the samples, the step 78 consists simply of reallocating the sign of the original sample e(n) to the modified sample $e_{mod}(n)$.

Steps 75 to 78 are repeated for a next sample e(n) (n becomes n+1 in step 79), until the pitch period $T_0$ is exhausted (therefore until reaching the last valid sample e($n_1$)).

Thus the modified signal $e_{mod}(n)$ is delivered to the inverse filter 1/A(z) (reference 405 in FIG. 4) for the remainder of the decoding.

However, two possible variant embodiments should be noted. It is possible to correct the last pitch period $T_j$ in this way, to apply this correction $T'_j$ to this last pitch period $T_j$ and to copy the correction for the next pitch periods, i.e.: $T_j=T_{j+1}=T_{j+2}=T'_j$.

In a variant, the last pitch period $T_j$ is left intact and on the other hand its correction $T'_j$ is copied into the next pitch periods $T_{j+1}$ and $T_{j+2}$.

Comparison of FIGS. 5 and 6 shows how the modification of the excitation thus carried out is advantageous. Thus, in brief, in the case where a plosive is present in the last pitch period, the latter will be automatically removed before pitch repetition, as it will have no equivalent in the penultimate pitch period. This implementation thus makes it possible to remove one of the more troublesome artefacts of the pitch repetition consisting of the repetition of plosives.

Moreover, advantageously a quicker attenuation of the synthesized and repeated signal is provided, if a plosive is detected in the last pitch period. An example embodiment of a detection of a transitory, in general terms, can consist of counting the number of occurrences of the following condition (1):

$$\frac{|e(n)|}{4} > \max_{i=-k,etc.,0,etc.,+k} (|e(n-T_0+i)|)$$

If this condition is verified for example more than once over the current frame, then the past signal xl comprises a transitory (for example a plosive), which makes it possible to force a quick attenuation by the bloc 406 on the synthesis signal yl (for example an attenuation over 10 ms).

Figures 2A, 2B, 2C:
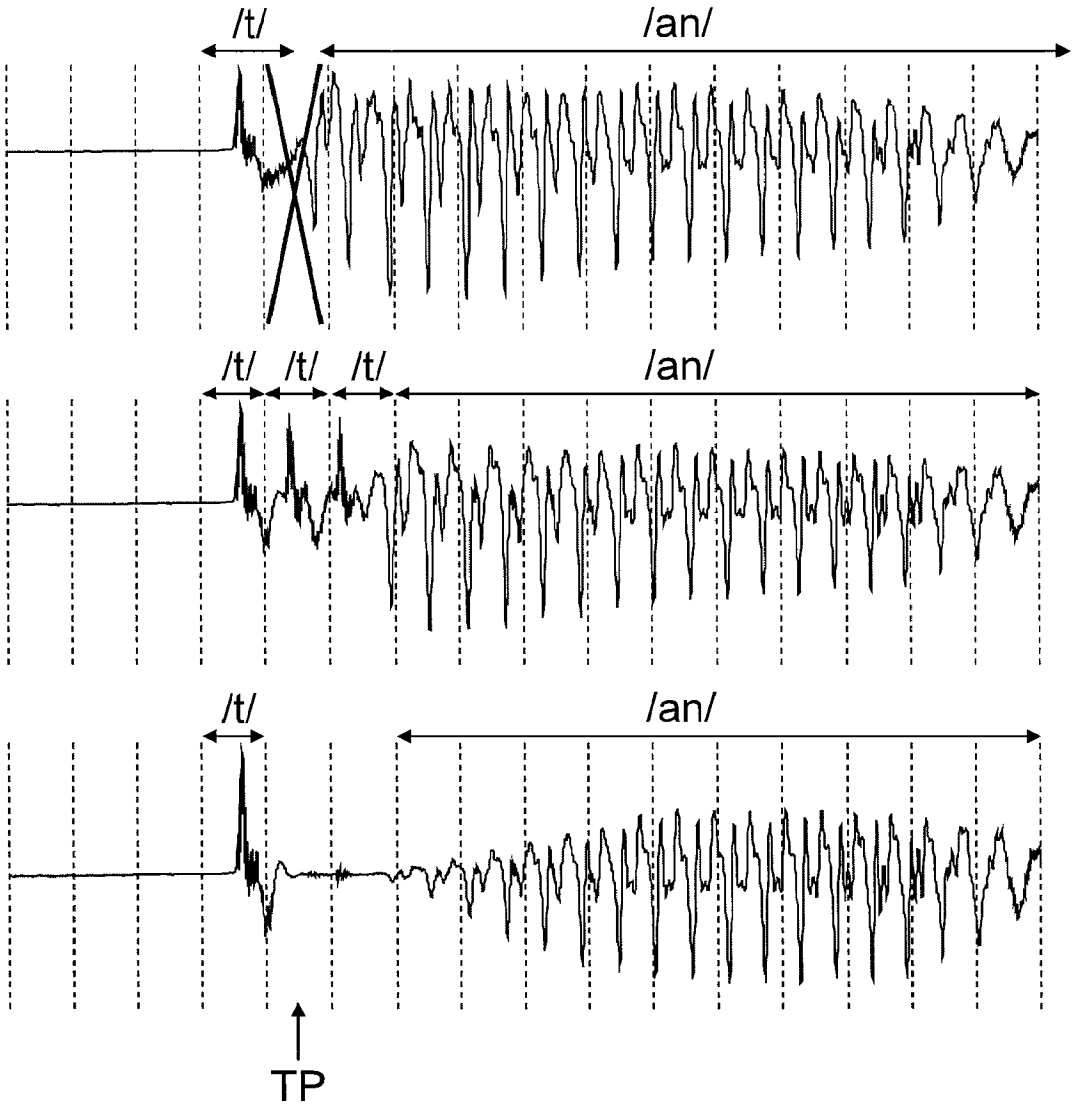
FIG. 2*c* illustrates, by way of comparison, the effect of the processing within the meaning of the invention on the same signal as that of FIGS. 2*a* and 2*b*, for which a frame TP has been lost.

FIG. 2*c* thus illustrates the decoded signal when the invention is implemented, by way of comparison with FIGS. 2*a* and 2*b* for which a frame comprising the plosive /t/ was lost. Repetition of the phoneme /t/ is avoided in this case, due to implementation of the invention. The differences which follow the loss of frames are not linked to the actual detection of plosives. In fact, the attenuation of the signal after the a loss of frames in FIG. 2*c* can be explained by the fact that in this case, the G.722 decoder is reinitialized (complete update of the states in the block 302 of FIG. 3), while in the case of FIG. 2*b*, the G.722 decoder is not reinitialized. It will be understood nevertheless that the invention relates to the detection of plosives for the extrapolation of an erased frame and not to the problem of restarting after a frame loss.

However, to the ear, the signal illustrated in FIG. 2*c* is of better quality than that of FIG. 2*b*.

The present invention also relates to a computer program intended to be stored in the memory of a digital audio signal synthesis device. This program then comprises instructions for the implementation of the method within the meaning of the invention, when it is executed by a processor of such a synthesis device. Moreover, the previously-described FIG. 7 can illustrate a flow-chart of such a computer program.

Moreover, the present invention also relates to a digital audio signal synthesis device constituted by a succession of blocks. This device could further comprise a memory storing the above-mentioned computer program and could consist of the block 403 of FIG. 4 with the functionalities described above. With reference to FIG. 8, this device SYN comprises:

- a input I for receiving blocks of the signal e(n), preceding at least one current block to be synthesized, and
- output O for delivering the synthesized signal $e_{mod}(n)$ and comprising at least this current synthesized block.

The synthesis device SYN within the meaning of the invention comprises means such as a working storage memory MEM (or for storing the above-mentioned computer program) and a processor PROC cooperating with this memory MEM, for the implementation of the method within the meaning of the invention, and thus for synthesizing the current block starting from at least one of the preceding blocks of the signal e(n).

The present invention also relates to a digital audio signal decoder, this signal being constituted by a succession of blocks and this decoder comprising the device 403 within the meaning of the invention for synthesizing invalid blocks.

More generally, the present invention is not limited to the embodiments described above by way of example; it extends to other variants.

In variant embodiments, the parameters for correction of the pitch period and/or for detection of transitories can be the following. An interval is taken comprising a different number of three samples in the penultimate pitch period. For example k=2 can be taken in order to have five samples considered in total. Similarly, it is possible to adapt the threshold value for transitory detection (¼ in the example of condition (1) above). Moreover, it is possible to declare the signal as a transitory if the detection condition is verified at least m times, with $m \geqq 1$.

Moreover, the invention can equally be applied to contexts other than that described above.

For example, the signal detection and modification can be carried out in the signal domain (rather than the excitation domain). Typically, for the correction of frame losses in a CELP decoder (which also operates according to the source-filter model), the excitation is extrapolated by repetition of the pitch and optionally, addition of a random contribution, and this excitation is filtered by a filter of the 1/A(z) type, where A(z) is derived from the last predictive filter correctly received.

It can also be applied equally well to a decoder according to the G.711 standard.

Of course, simply copying the penultimate pitch period $T_{j-1}$ in order to constitute the new synthesized periods $T_{J+1}$, $T_{j+2}$ would already make it possible to overcome the problem of repetition of plosives, if in addition, arrangements are made to detect plosives in the penultimate pitch period (for example by using a condition of the type of condition (1) above). This embodiment is within the scope of the invention.

Moreover, for reasons of clarity in the above description, a correction of samples in step b) was described, followed by copying the corrected samples into the replacement block(s). Of course, technically in a strictly equivalent fashion, it is also possible to firstly copy the samples of the last repetition period and then correct them all in the replacement block(s). Thus, the correction of samples and the copying can be steps which can take place in any order and, in particular, can be reversed.

The invention claimed is:

1. A method for synthesizing a digital audio signal, represented by successive blocks of samples, in which on receiving such a signal, in order to replace at least one invalid block, a replacement block is generated from samples of at least one valid block preceding the invalid block, the method comprising the following steps:

a) determining a repetition period in at least one valid block, and b) copying the samples of the repetition period into at least one replacement block, wherein:

in step a), a last repetition period is determined in at least one valid block immediately preceding an invalid block, in step b), the samples of said last repetition period are corrected according to samples of a previous repetition period preceding said last repetition period, in order to limit the amplitude of any transitory signal in said last repetition period, and the samples thus corrected are copied into said replacement block.

2. The method according to claim 1, in which the signal is a voiced speech signal, and the repetition period is a pitch period corresponding to the inverse of a fundamental frequency of the signal.

3. The method according to claim 1, wherein, in step b), a current sample of the last repetition period is corrected, by comparing:

the amplitude of this current sample, in absolute value, to the amplitude, in absolute value, of at least one sample temporally positioned approximately at a repetition period before the current sample, and by assigning to the current sample the minimum amplitude, in absolute value, from these two amplitudes.

4. The method according to claim 3, wherein, for a current sample of the last repetition period:

a set of samples is constituted in a neighbourhood centered around a sample temporally positioned at a repetition period before the current sample, a chosen amplitude is determined from the amplitudes of the samples of said neighbourhood, taken in absolute value, and this chosen amplitude is compared to the amplitude of the current sample, in absolute value, in order to assign to the current sample the minimum amplitude, in absolute value, from the chosen amplitude and the amplitude of the current sample.

5. The method according to claim 4, wherein the amplitude chosen from the amplitudes of the samples of said neighbourhood is the maximum amplitude in absolute value.

6. The method according to claim 1, in which the digital audio signal is a speech signal, wherein a degree of voicing is detected in the speech signal and in that steps a) to d) are implemented if the speech signal is non-voiced or weakly voiced.

7. The method according to claim 3, in which a damping of the amplitude of the samples in said replacement block is applied, wherein any transitory feature of the signal in the last repetition period is detected and, if applicable, a quicker damping is applied than for a stationary signal.

8. The method according to claim 7, wherein, in step b), a current sample of the last repetition period is corrected, by comparing:

the amplitude of this current sample, in absolute value, to the amplitude, in absolute value, of at least one sample temporally positioned approximately at a repetition period before the current sample, and by assigning to the current sample the minimum amplitude, in absolute value, from these two amplitudes, and wherein:

for a plurality of current samples of the last repetition period, a relationship is measured, in absolute value, of the amplitude of a current sample to the above-mentioned chosen amplitude, and the number of occurrences for said current samples, for which said relationship is greater than a first predetermined threshold is counted, and the presence of a transitory feature is detected if the number of occurrences is greater than a second predetermined threshold.

9. The method according to claim 1, wherein, in the case of reception of a plurality of consecutive invalid blocks extending over at least one repetition period, the sample correction step b) is applied to all the samples of the last repetition period, taken one by one as a current sample.

10. The method according to claim 9, wherein, in the case of reception of a plurality of consecutive invalid blocks extending over several repetition periods, in order to replace said plurality of invalid blocks, the repetition period corrected in step b) is copied several times in order to form the replacement blocks.

11. A non-transitory memory in a digital audio signal synthesis device comprising a computer program comprising instructions for the implementation of the method according to claim 1 when it is executed by a processor of such a synthesis device.

12. A digital audio signal synthesis device constituted by a succession of blocks, comprising:

an input for receiving blocks of the signal, preceding at least one current block to be synthesized, and an output for delivering the synthesized signal and comprising at least said current block, comprising means for the implementation of the method according to claim 1, for synthesizing the current block from at least one of said preceding blocks.

13. A decoder of a digital audio signal constituted by a succession of blocks, comprising moreover a device according to claim 12, for synthesizing invalid blocks.

* * * * *